US005365708A

United States Patent [19]

Winston

[11] Patent Number: 5,365,708

[45] Date of Patent: Nov. 22, 1994

[54] DOOR FRAME SYSTEM

[75] Inventor: Felix J. Winston, Anniston, Ala.

[73] Assignee: Jenkins Manufacturing Co., Inc., Anniston, Ala.

[21] Appl. No.: 21,045

[22] Filed: Feb. 23, 1993

[51] Int. Cl.[5] ..... E06B 1/10

[52] U.S. Cl. ..... 52/212; 52/211; 52/210; 52/217; 52/717.01; 49/505; 49/504

[58] Field of Search ..... 52/210–217, 52/717.01, 730.1, 730.7, 731.7, 731.8; 49/504, 505

[56] References Cited

U.S. PATENT DOCUMENTS

| | | | |
|---|---|---|---|
| 1,197,031 | 9/1916 | Kelly . | |
| 1,347,172 | 7/1920 | Malcolm . | |
| 1,855,470 | 4/1932 | Bilton | 52/212 |
| 2,736,930 | 3/1956 | Longley | 52/211 |
| 3,040,390 | 6/1962 | Carlton | 52/211 |
| 3,119,156 | 1/1964 | Salter, Jr. . | |
| 3,545,135 | 12/1970 | Lieber | 52/213 X |
| 3,614,846 | 10/1971 | Donnelly et al. | 52/213 |
| 3,800,488 | 4/1974 | Swanson . | |
| 3,808,759 | 5/1974 | Carmichael . | |
| 4,012,868 | 3/1977 | Andruszkiewicz . | |
| 4,019,303 | 4/1977 | McAllister . | |
| 4,126,975 | 11/1978 | Williams . | |
| 4,589,229 | 5/1986 | Warren . | |

FOREIGN PATENT DOCUMENTS

| | | | |
|---|---|---|---|
| 1073661 | 6/1967 | United Kingdom | 49/505 |
| 1444425 | 7/1976 | United Kingdom | 49/505 |
| 2012848 | 8/1979 | United Kingdom | 49/505 |

*Primary Examiner*—Carl D. Friedman
*Assistant Examiner*—Robert J. Canfield
*Attorney, Agent, or Firm*—Cushman, Darby & Cushman

[57] ABSTRACT

A jamb assembly is used to form a door frame system for installation within a wall having an opening for a door. The jamb assembly comprises a first elongated member having an L-shaped shoulder along one side of the member. A groove running parallel to the shoulder extends the length of the member. The jamb assembly has a second elongated member identical to the first member. The members are inverted relative to one another so that the L-shaped shoulders of the first and second members fit together to form an expandable base of the jamb assembly. A third elongated member has a tongue projecting on one side thereof that extends the length of the third member. The tongue is formed to fit into the groove of the first or the second elongated member to form a cap for the jamb assembly. The tongue extends beyond the ends of the first and second members when the jamb assembly serves as a head jamb assembly. The third elongated member is shorter than the first and second elongated members when the jamb assembly serves as a side jamb assembly. The first and second elongated members have multiple scoring lines along the edges to permit proper alignment of a casing to the door frame.

9 Claims, 3 Drawing Sheets

DOOR FRAME SYSTEM

BACKGROUND OF THE INVENTION

1. Field of the Invention

The present invention generally relates to a door frame system, and more particularly to a three-piece jamb assembly for an interior door frame system.

2. Description of the Prior Art

The construction industry has a number of options available for door frames and ways to assemble the jamb assemblies thereof. Over the years, a variety of assembly methods have been developed to facilitate the construction of door frames and jamb assemblies.

During construction of a home or the like, an opening is left in the wall in which the door frame and door are installed. A conventional method is to custom build a door frame in the door opening. After the door frame is built, the door is hung within the door frame. However, jamb assemblies are available to help the builder in installing doors. The jamb set usually consists of side and head jamb assemblies, each jamb assembly having a base and a cap. While this arrangement presents the builder with certain advantages, e.g., ease in the installation of different width and height door frames, such a construction technique can be time consuming and cumbersome, and it does not provide an easy and accurate way of positioning the cap on the base of the jamb assembly or of positioning the head jamb assembly together with the side jamb assemblies. Several arrangements attempting to address such problems are disclosed, for example, in Carmichael U.S. Pat. No. 3,809,759, Andruszkiewicz Pat. No. 4,012,868, McAllister U.S. Pat. No. 4,019,303.

Another method of door frame and door installation is the use of pre-hung doors. Pre-hung doors are manufactured so that a door frame and door are installed directly in a door opening. The pre-hung doors come in a variety of standard sizes. Pre-hung doors provide the builder with a quick and easy method of installing a door frame and door. However, pre-hung doors do not allow for non-standard door sizes or non-standard frame widths, heights, and depths.

After the door frame and door are installed, a casing is normally added to finish the appearance of the door. Casings typically must be custom made by the builder inasmuch as conventional door frame sets, or pre-hung doors, do not provide aids to the installation of a casing.

SUMMARY OF THE INVENTION

As is evident from the foregoing description, there are a number of limitations to existing systems for door installation. Therefore, it is an object of the present invention to provide an improved door frame system that can be quickly and easily installed in door openings of different sizes.

It is a further object of the present invention to provide a door frame system formed from jamb assemblies that have an expandable base.

It is yet a further object of the present invention to provide a jamb assembly that has a cap for the expandable base that it is easy to install.

It is a still further object of the present invention to provide a jamb assembly for a door frame system that allows for right or left side opening.

It is another object of the present invention to provide an easy and accurate way to align and install a head jamb assembly to side jamb assemblies to make a door frame system.

It is yet another object of the present invention to provide an easy and accurate way to align and install a casing for the door frame system.

To achieve these results the present invention provides a jamb assembly to be used in a door frame system for installation within a wall having an opening for a door. The jamb assembly comprises a first elongated member having an L-shaped shoulder along one side of the member. A groove running parallel to the shoulder extends the length of the member. The jamb assembly further comprises a second elongated member identical to the first member. The members are inverted relative to one another so that the L-shaped shoulders of the first and second members fit together to form an expandable base for the jamb assembly. Finally, the jamb assembly includes a third elongated member which has a projecting tongue on one side thereof extending the length of the third member. The tongue is formed to fit snugly into one of the grooves of the first or second elongated member so that the third member forms a cap for the expandable base. When the assembly is to be used as a head jamb assembly, the tongue of the third elongated member extends beyond the ends of the member. For a side jamb assembly, the third elongated member is shorter in length than the first and second elongated members. This permits the tongue extension of a head jamb assembly to fit into an exposed portion of the groove of a side jamb assembly. The first and second elongated members have score lines on their outer edges to permit proper alignment of casings when they are installed.

Other objects and advantages of the present invention will become apparent from the following detailed description of a preferred embodiment of the invention taken in conjunction with the accompanying drawings.

DETAILED DESCRIPTION OF THE PRESENTLY PREFERRED EXEMPLARY EMBODIMENTS

Figure 1:
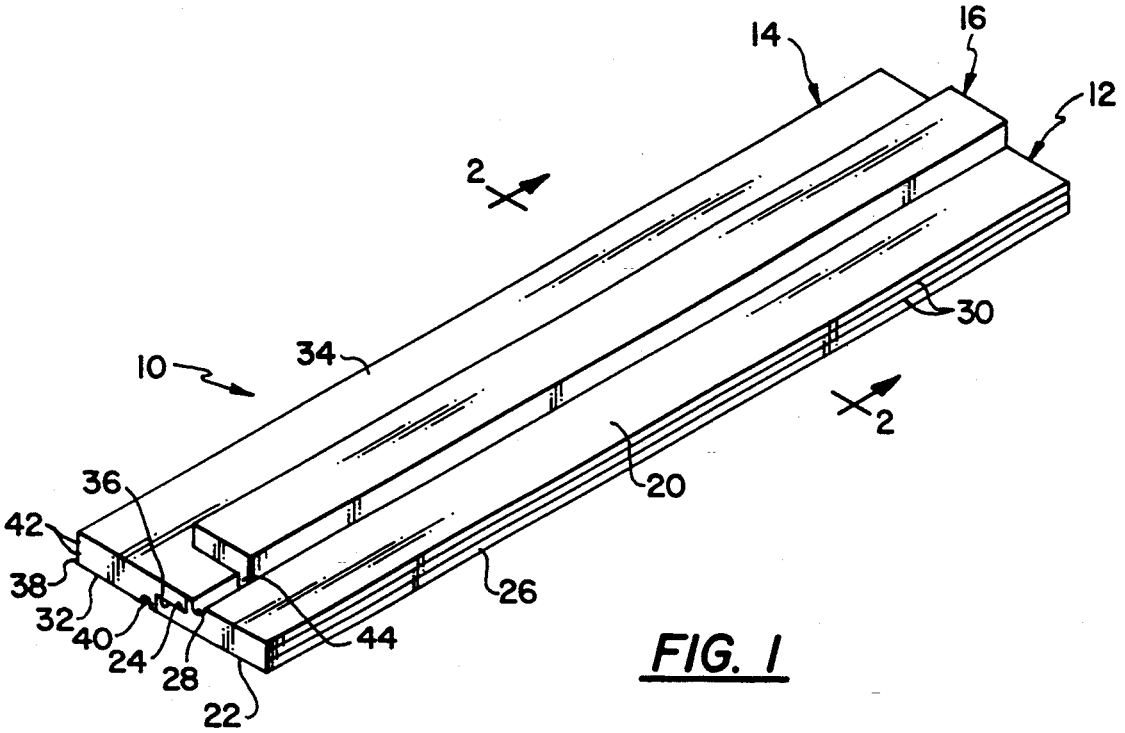
FIG. 1 is a perspective view of a jamb assembly for a door frame system embodying the principles of the present invention.
Figure 2:
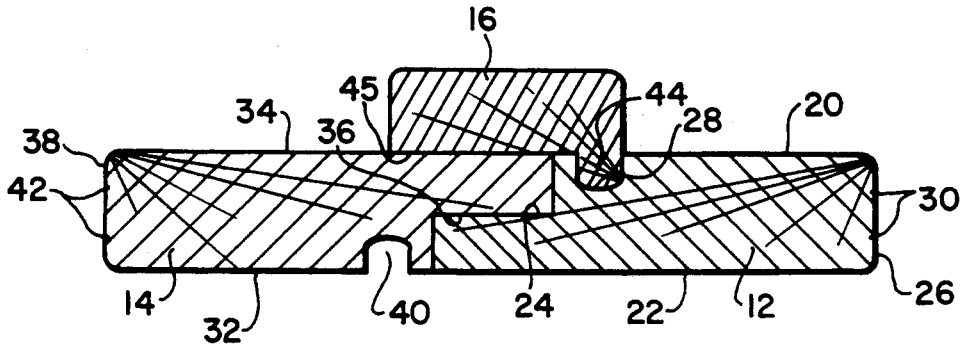
FIG. 2 is a sectional view of the jamb assembly taken along the line 2—2 in FIG. 1.

Referring now to the drawings, and more particularly to FIG. 1, there is shown therein a jamb assembly, generally indicated at 10, to be used in a door frame system, which embodies the principles of the present invention. The jamb assembly 10 comprises three basic components: (1) a first elongated member, generally indicated at 12; (2) a second elongated member, generally indicated at 14, which fits together with first elongated member 12 to form the base of the jamb assembly 10, and (3) a third elongated member, generally indicated at 16, which is adapted to cooperately fit either with the first elongated member 12 (as shown) or with the second elongated member 14 (not shown). Member 16 serves as a cap for the jamb assembly 10.

A door frame system is formed by at least three jamb assemblies 10: two side jamb assemblies for the sides of the door frame and a head jamb assembly for the top of the door frame. The head jamb assembly extends between the tops of two side jamb assemblies.

First elongated member 12, second elongated member 14, and third elongated member 16 are preferably wood of any suitable type, e.g., white pine. It will be understood, however, that in its broader aspects the invention contemplates the use of other materials that are suitable in the construction of jamb assemblies.

First elongated member 12 and second elongated member 14 are cut from standard 4/4 lumber to a desired thickness of about three-quarters of an inch. Of course, other thickness and width dimensions can be used. Third elongated member 16 is cut to a thickness and width dependent on the requirements of the door frame.

Referring more particularly to the drawings, first elongated member 12 has a top side 20 and a bottom side 22. Top side 20 is provided at one of its edges with a substantially L-shaped shoulder 24. At the opposite side of the member 12, the top and bottom sides are joined by an edge 26. Member 12 additionally has a groove 28 spaced from shoulder 24 and running the length of top side 20. Groove 28 is positioned closer to shoulder 24 than to edge 26. It should be noted, however, that the groove 28 can be placed at any location along the width of the top side 20 depending on the requirements of the door frame being built. Multiple score lines 30 are formed along the length of edge 26 and are used to align a casing with the door frame, as will be discussed below. The preferred embodiment shows two score lines 30, but it should be understood that the present invention envisions more or fewer score lines depending upon needs.

Second elongated member 14 is substantially identical in shape and size as first elongated member 12. Member 14 has opposite sides 32 and 34, an L-shaped shoulder 36, a groove 40 in side 32, an outside edge joining sides 32 and 34, and multiple score lines 42 in edge 38.

Figure 3A:
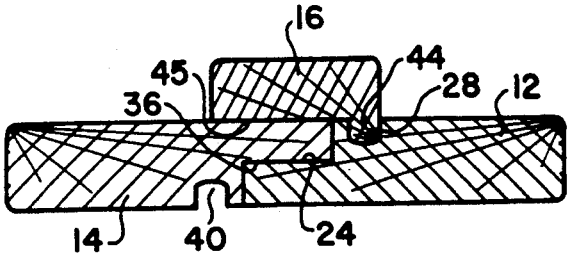
FIGS. 3*a* and 3*b* are views of the jamb assembly taken along the line 2—2 in FIG. 1 showing the expandability of the system.
Figure 3B:
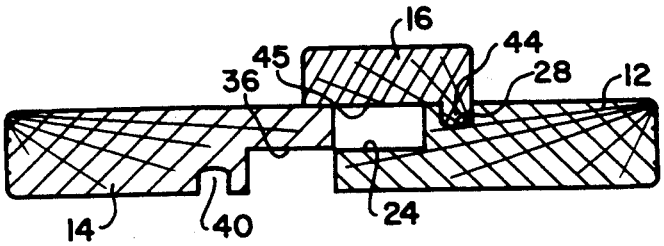

In the embodiment shown in FIGS. 1 and members 12 and 14 are inverted relative to one another whereby the L-shaped shoulders 24 and 36 of members 12 and 14 fit together so that the resultant top and bottom surfaces of the assembly are flush with one another. The two members 12 and 14 thus form the base of a jamb assembly which is smooth from edge 26 to edge 38, except for the presence of grooves 28 and 40. As can be seen in FIGS. 3*a* and 3*b*, the base of the assembly can be expanded by separating the two shoulders 24 and 36 so that they are not fully nested with one another.

Third elongated member 16 generally has the same thickness as the first and second elongated members, but is narrower. Of course, the dimensions of the third elongated member can vary as required. A projecting tongue 44 is formed along one edge of a side 45 of the third elongated member 16. It will be appreciated, however, that tongue 44 may be spaced from the edge of side 45. Tongue 44 is sized so that it fits snugly into either groove 28 of first elongated member 12 or groove 40 of second elongated member 14.

When member 16 is secured to either member 12 or member 14 such that the tongue 44 projects into one of the grooves 28 and 40, the third elongated member forms a cap for the base of jamb assembly 10. Member 16 covers the joint made by members 12 and 14. Since the base is expandable as described above, member 16 must be sufficiently wide to cover the gap between the members and 14 when the base is expanded.

Figure 4:
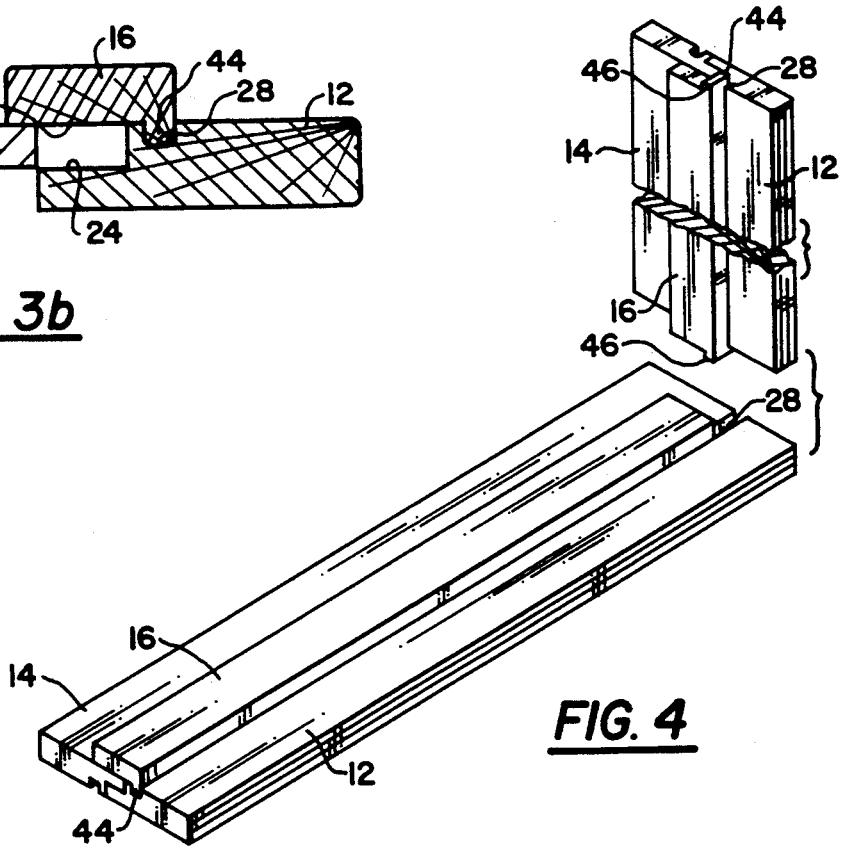
FIG. 4 is a perspective view of a side jamb assembly and head jamb assembly for a door frame system embodying the principles of the present invention.

The length of the third elongated member relative to the first and second elongated members 12 and 14 varies depending on whether the combination is used as a side jamb assembly or a head jamb assembly. In the case of the elongated member being used as a side jamb assembly, member 16 is shortened at one end of the assembly (FIG. 1 and 4). The difference in length between the third elongated member 16 and the first and second elongated members 12 and 14 is substantially equal to the thickness of the head jamb assembly. In the latter, the third elongated member 16 is substantially the same length as the first and second elongated members 12 and 14. Consequently, when the head and side jamb assemblies are joined, the ends of the head jamb assembly will fit accurately within the pocket formed at the ends of the side jamb assemblies by the shortened member Therefore, a precisely dimensioned finished door frame is formed for installation into the door opening.

As seen in FIG. 4, the ends of tongue 44 of the head jamb assembly extend beyond the ends of the third elongated member 16. The extensions 46 fit snugly within the exposed portions of the grooves 28 or 40 of the side jamb assemblies. The extensions 46 aid in the positioning of the head jamb assembly relative to the side jamb assemblies.

Figure 5:
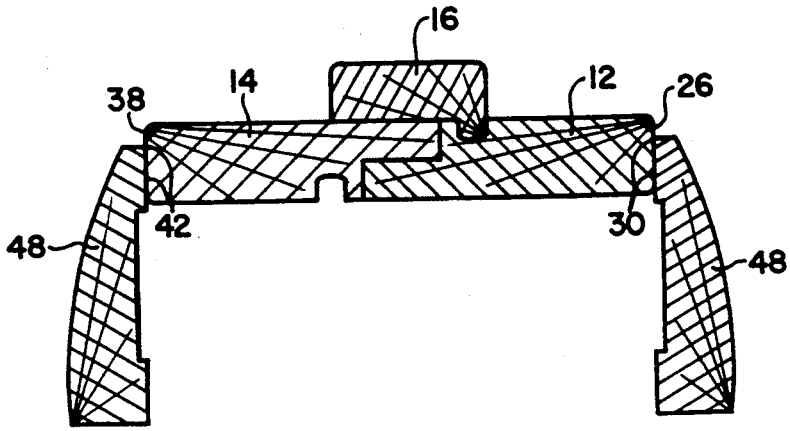
FIG. 5 is a sectional view taken along the line 2—2 in FIG. 1 illustrating the jamb assembly and a casing added in accordance with the principles of the present invention.
Figure 6:
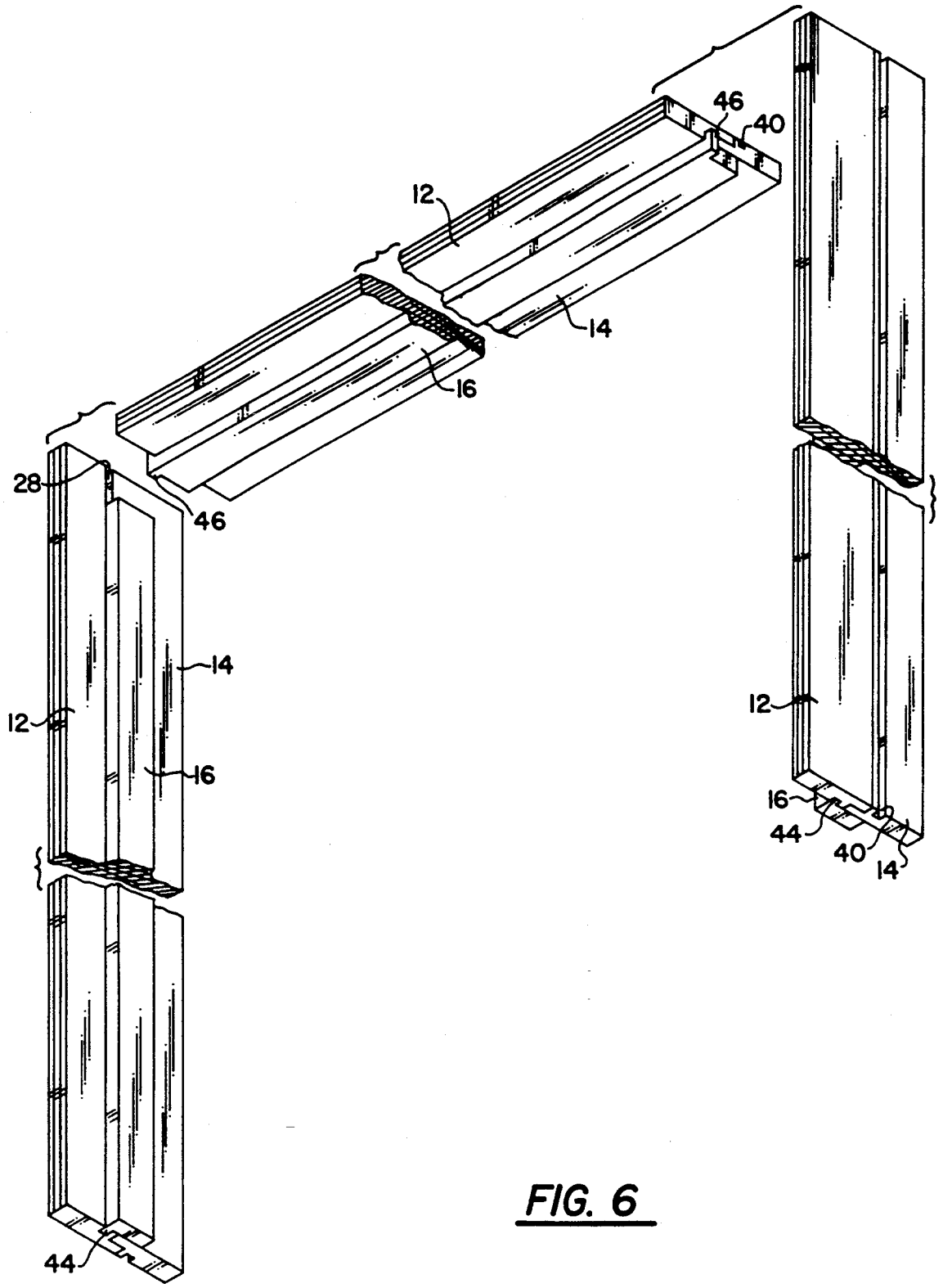
FIG. 6 is a complete door frame system comprised of the jamb assemblies of FIGS. 1–5.

FIG. 5 illustrates multiple score lines 30 and 42 formed on the respective edges 26 and 38 of the first and second elongated members 12 and 14. Casing members are installed around the jamb assemblies to finish the door frame. Score lines 30 and 42 offer the installer visual alignment mean for accurate positioning of casing members 48 on the door frame. The casing member may be installed either at the point of manufacture of the door frame system or on site.

Examples of the installation and operation of a door frame system will now be explained relative to a typical installation in which a door swings on hinges. It will be understood that each jamb assembly 10 for forming a door frame system comes in a variety of lengths to accommodate the various heights and widths of door openings. It will be further understood that door frames made from jamb assemblies 10 can accommodate prehung doors, or the door frame can be assembled separately and the door then hung. Once each jamb assembly is cut to fit a particular opening, the door frame is assembled. For each of two side assemblies, the first and second elongated members 12 and 14 are positioned relative to accommodate the depth of the opening. See FIG. 3*b*. Members 12 and 14 are then connected by hot melt glue, nails or other conventional securing method.

After the side assemblies are so formed, caps are put on each. As stated above, the third elongated member 16 is used as a cap. Depending on whether the door is intended for right side or left side installation, the third elongated member is positioned on one side or the other of the side jamb assembly flush with one end of the base. The cap is attached to the base by applying hot melt glue to member 16 and/or to members 12 or 14 so as to bond them. Nails or other securing methods also can be used.

The head jamb assembly is put together in the same manner as the two side jamb assemblies.

Once the two side jamb assemblies and the head jamb assembly are put together, the door frame can be made by joining the assemblies. The head cap tongues 46 are inserted into the exposed portions of the grooves in the side jamb assemblies. See FIG. 4. The head jamb assembly is inserted so that the edges of the caps of the side jamb assemblies and the head jamb assembly are flush. The head jamb assembly is attached to the side jamb assemblies by hot melt glue, nails or other securing methods. A full door frame system is thus formed.

Within the door frame, a door can be hung. One side jamb assembly is used for the hinges and the other side jamb assembly is used for the strike plate. The hinges and strike plate are inserted on the portion of the side jamb assemblies that receive tongue 44 which, in the drawings, is shown as first elongated member 12.

Typically, a door frame system made of jamb assemblies 10, as discussed above, is manufactured with a pre-hung door. This offers the builder the greatest ease in installation. It should be understood, however, that the door can be hung on site. When the door frame system contains a pre-hung door, the frame assemblies are delivered to the building site held together by removable brads. The brads are removed so that the jamb assembly can be adapted to the depth of the door opening.

To properly align the casing members 48 on the door frame and to position them correctly all around the door frame, the assembler or the on-site installer uses the score lines provided. Because the score lines are placed at consistent points on the casing edges 26 and 38, the casing will be aesthetically positioned on the door frame.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which will fall within the purview of the subject invention and claims.

What is claimed is:

1. A jamb assembly for use in a door frame system for installation within a wall having an opening for a door, said jamb assembly comprising:

a first elongated member having a top side and a bottom side, said top side being provided at one of its edges with an L-shaped shoulder, said top side having a groove extending along the length of said first member;

a second elongated member having a shape substantially identical to said first member wherein when said members are inverted relative to one another, the shoulders of said first and second members fit together thereby forming a base of said jamb assembly; and a third elongated member having a tongue extending along the length of said third member, said tongue fitting into the groove of one of said first and second members so that said third elongated member forms a cap for said base.

2. A jamb assembly according to claim 1, wherein said base is expandable by separating said first member and said second member so that the shoulders of said members only partially engage one another.

3. A jamb assembly according to claim 1, wherein said third member is shorter than said first and second members so that a portion of said groove remains exposed in said base when said cap is secured to said base.

4. A jamb assembly according to claim 1, wherein said tongue extends beyond the ends of said third member.

5. A jamb assembly according to claim 1, further comprising:

multiple score lines extending the length of the edges of said first and second members along edges of said members opposite the edges having L-shaped shoulders, said score lines providing means for aligning a casing member with said base.

6. A door frame system for installation within a wall having an opening for a door, comprising:

a head jamb assembly including:

a) a first elongated member having a top side and a bottom side, said top side being provided at one of its edges with an L-shaped shoulder, said top side having a groove extending the length of Said first member;

b) a second elongated member having a shape substantially identical to said first member wherein when said members are inverted relative to one another, the shoulders of said first and second members fit together thereby forming a base of said head jamb assembly;

c) a third elongated member having a tongue extending along the length of, and beyond the ends of, said third member, said tongue fitting into the groove of one of said first and second members to form a cap for said head jamb assembly; and multiple side jamb assemblies joined to opposite ends of said head jamb assembly, each side jamb assembly including:

d) a fourth elongated member having a top side and a bottom side, said top side being provided at one of its ends with an L-shaped shoulder, said top side having a groove extending the length of said fourth member;

e) a fifth elongated member having a shape substantially identical to said fourth member wherein when said fourth and fifth members are inverted relative to one another, the shoulders of said members fit together thereby forming a base of said side jamb assembly; and f) a sixth elongated member having a tongue extending along the length of said member, said sixth member being shorter than said fourth and fifth members, said tongue of the sixth member fitting into the groove of one of said fourth and fifth members so as to form a cap for said side jamb assembly so that a portion of said groove of said side jamb assembly base is exposed to accommodate an extending portion of the tongue of said head jamb assembly to form said door frame system.

7. A door frame system according to claim 6, further comprising:

multiple score lines extending the length of the edges of said fourth and fifth members along edges of said members opposite the edges having L-shaped shoulders, said score lines providing means for aligning a casing member to said side jamb assembly base.

8. A door frame system according to claim 6, wherein said side jamb assembly base is expandable by separating said fourth and fifth members so that the shoulders of said members only partially engage one another.

9. A door frame system according to claim 6, wherein said caps of said head jamb assembly and said multiple side jamb assemblies form continuous caps around said system.

* * * * *